US007721351B2

(12) United States Patent
Valat et al.

(10) Patent No.: US 7,721,351 B2
(45) Date of Patent: May 25, 2010

(54) PROTECTIVE ASSEMBLY FOR A LIMB

(75) Inventors: Gerard Valat, Aix en Provence (FR); Cedric Ragot, Paris (FR)

(73) Assignee: Random Design, Aix-en-Provence (FR)

( * ) Notice: Subject to any disclaimer, the term of this patent is extended or adjusted under 35 U.S.C. 154(b) by 1494 days.

(21) Appl. No.: 10/518,630

(22) PCT Filed: Jun. 17, 2003

(86) PCT No.: PCT/FR03/01836

§ 371 (c)(1),
(2), (4) Date: Dec. 20, 2004

(87) PCT Pub. No.: WO04/000055

PCT Pub. Date: Dec. 31, 2003

(65) Prior Publication Data

US 2005/0223599 A1 Oct. 13, 2005

(30) Foreign Application Priority Data

Jun. 20, 2002 (FR) ..... 02 07635

(51) Int. Cl.
*A41D 13/00* (2006.01)

(52) U.S. Cl. ..... 2/22; 36/83

(58) Field of Classification Search ..... 2/16, 2/22, 24, 242, 455, 911; 128/878, 882; 602/23, 602/26, 62; 36/1.5, 2 R, 117.1, 118.1, 83
See application file for complete search history.

(56) References Cited

U.S. PATENT DOCUMENTS

| | | | | |
|---|---|---|---|---|
| 4,587,749 | A | 5/1986 | Berlese | |
| 5,090,138 | A | 2/1992 | Borden | |
| 5,279,053 | A * | 1/1994 | Pallatin et al. | 36/118.9 |
| 5,386,650 | A * | 2/1995 | Storz | 36/118.3 |
| 6,554,297 | B2 * | 4/2003 | Phillips et al. | 280/14.22 |
| 6,691,434 | B1 * | 2/2004 | Couturier | 36/117.1 |

FOREIGN PATENT DOCUMENTS

JP 61-290902 12/1986

* cited by examiner

*Primary Examiner*—Tejash Patel
(74) *Attorney, Agent, or Firm*—Young & Thompson

(57) ABSTRACT

A protective assembly for a limb, in particular the shaft-forming part of a motorcycle boot, which is designed to protect the tibia of the motorcyclist. The inventive assembly includes: an essentially tubular body (2) including a slit, which extends along a longitudinal axis (6) and which is designed to fit around the limb; a rigid tongue (10) which is designed to cover the front part of the body and which extends along both sides of the slit; and a flange (12) which extends transversely to the longitudinal direction between the edges of the slit, the flange being adjustably-connected to the body on either side of the slit so that the distance between the edges can be adjusted. The aforementioned tongue is mounted to the flange such that it can slide freely and the tongue and the body co-operate in order automatically to align the tongue in relation to the slit.

20 Claims, 1 Drawing Sheet

PROTECTIVE ASSEMBLY FOR A LIMB

This is a 371 National Stage application of International application no. PCT/FR2003/01836, filed Jun. 17, 2003, which claims priority to French application no. 02/07635, filed Jun. 20, 2002. The entire contents of the above-referenced applications are hereby incorporated by reference in their entirety.

The invention relates to a limb protection assembly, in particular a portion which forms an upper of a motorcycle boot which is intended to protect the tibia of a motorcyclist.

For reasons of simplification, reference will be made in the following text only to this application, although the invention may also be used to protect the forearm of an alpine skier against impacts with posts or the like.

BACKGROUND OF THE INVENTION

Protections are known of the type comprising:

- a substantially tubular body which extends in a longitudinal direction and which is intended to be adjusted around said limb and which has an aperture which extends in the longitudinal direction,
- a rigid tongue which is intended to cover a front portion of the body which extends at one side and the other of said aperture,
- a strap which extends transversely to the longitudinal direction between the edges of the aperture, said strap being connected to the body at one side and the other of the aperture in an adjustable manner in order to adjust the spacing between the edges of the aperture.

In order to adapt to the various morphologies of the users, the geometry of the boot must be adaptable with a relatively large adjustment range. Of course it is desirable for maximum protection to be provided for all users. Furthermore, for reasons of weight, ease of use and price, the assembly must be relatively simple.

SUMMARY OF THE INVENTION

Since the solutions from the prior art have hardly been satisfactory with regard to all these various points, the invention proposes that the tongue is carried by the strap on which it is mounted so as to slide freely and that the tongue and the body co-operate together in order to automatically centre the tongue relative to the aperture.

In this manner, the protection tongues are not displaced towards the inner side (towards each other) when the user has a large calf, nor towards the outer side in the opposite case. Effective protection is therefore provided, independently of the morphological characteristics of the user. Furthermore, this solution is simple and therefore inexpensive and light and does not require any particular care from the user when the boot is tightened.

According to another advantageous feature of the invention, the assembly further comprises locking means which have an inactive position in which they allow the tongue to slide freely on the strap and an active position in which they act counter to said sliding, and the locking means are placed in an active position when the tongue is pressed against said front zone.

The assembly is thus always easy to use, but the protection tongue also effectively remains in position, even in the case of a violent impact.

Advantageously, the locking means comprise:

- grooves which are provided in the strap,
- a catch having a shape which complements that of the grooves provided in the strap in order to engage therein, said catch resiliently assuming an inactive position in the absence of any external force and forming a protrusion relative to said tongue in the direction of said front zone when it is in said inactive position.

This solution is simple to use and is inexpensive to produce, particularly if the catch is produced by moulding with the tongue.

In order to automatically centre the tongue relative to the aperture, the invention proposes that:

- said front portion has a non-circular cross-section, and
- said tongue has a cross-sectional shape which complements that of the front portion.

It is thus not necessary to provide a complex mechanism in order to produce a centering of the tongue on the front portion of the body.

Advantageously, said front zone has a substantially parabolic cross-section.

This shape is particularly suitable for producing effective centering and it is also relatively similar to the shape of the tibia and the forearm.

In order to easily produce a strong tongue into which the strap extends freely, according to the invention, the tongue comprises two plastics components which are assembled together.

BRIEF DESCRIPTION OF THE DRAWINGS

The invention will be appreciated even more clearly from the following description, given with reference to the appended drawings, in which.

DETAILED DESCRIPTION OF THE INVENTION

Figure 1:
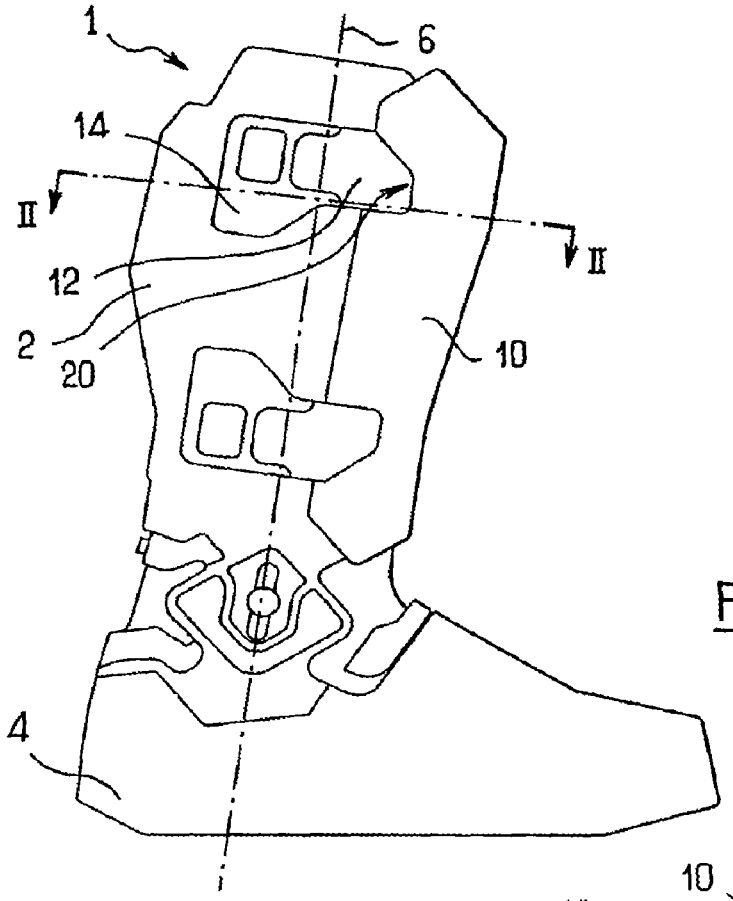
FIG. 1 is a side view of a motorcycle boot according to the invention.
Figure 2:
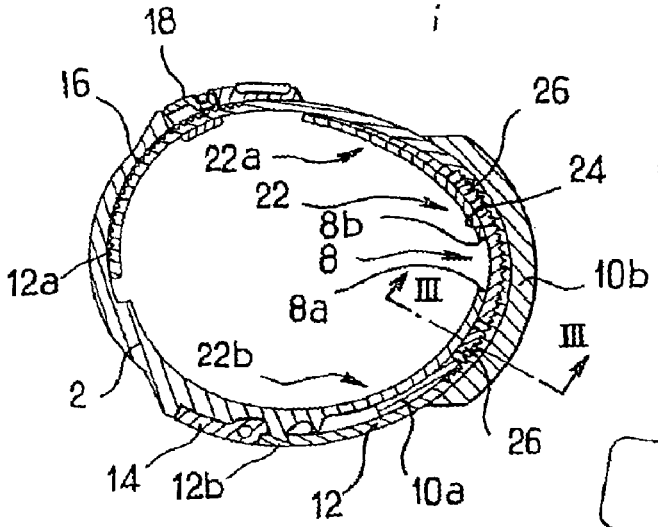
FIG. 2 is a cross-section along line II-II in FIG. 1.
Figure 3:
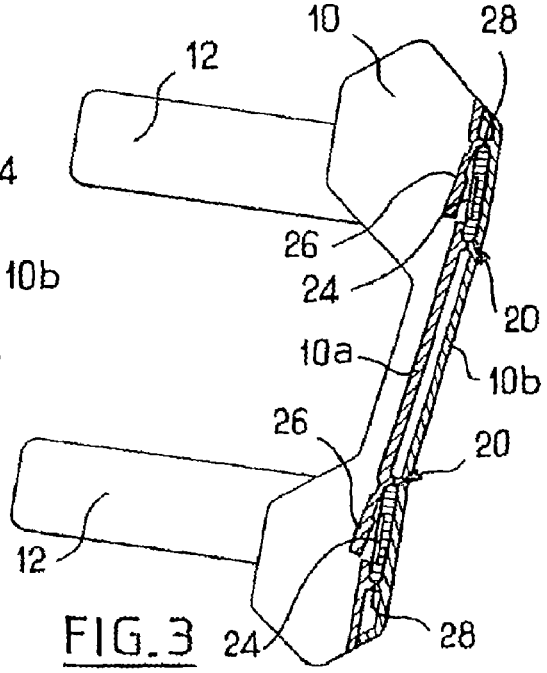
FIG. 3 is a view of only the tongue and the straps, sectioned along line III-III in FIG. 2.

FIGS. 1 to 3 illustrate a motorcycle boot 1 which comprises a body 2 intended to receive the leg of a motorcyclist and which is articulated relative to a base portion 4 which is intended to receive the foot of the motorcyclist.

The body 2 is defined by means of a substantially tubular rigid shell which extends in a longitudinal direction 6. This body 2 has an aperture 8 which extends in the longitudinal direction 6 over at least the main part of the length of the body 2.

The boot 1 further comprises a rigid protection tongue 10 which also extends in the longitudinal direction 6 and which covers the aperture 8. This tongue is carried by two straps 12 (an upper and lower strap) which extend transversely to the longitudinal direction 6 and which extend through the tongue 10 whilst allowing the tongue to slide freely on the straps 12.

Each of these straps 12 is connected, at a first end 12*a*, to the body 2 by means of a locking lever 14 (which also serves to unlock) and has, at a second end 12*b* which is opposite the first end 12*a*, notches 16 which co-operate with a fastening catch 18.

The fastening levers 14 and the fastening catches 18 are arranged at one side and the other of the aperture 8 and are connected to each other by means of the straps 12. The various notches 16 of the straps allow the width of the aperture 8 to be adjusted, that is to say, the distance between the edges 8*a* and 8*b* of the aperture, by varying the distance between the fastening levers 14 and the fastening catches 18.

The tongues 10 are received by a front portion 22 of the body 2 which extends at one side and the other of the aperture 8. This front portion 22 has a substantially parabolic cross-section which corresponds to the shape of the calf of a user in the tibial region.

The tongues 10 have a cross-section which complements the shape of the front portion 22 on which they are pressed when the boot is tightened using the notches 16, the fastening catches 18 and the fastening levers 14.

Owing to this complementary shape and the characteristics of the parabolic shape, that is to say, non-circular, with a continually increasing radius of curvature of the edges 8*a*, 8*b* of the aperture towards the transverse ends 22*a*, 22*b* of the front portion 22, and the free sliding of the tongue 10 on the straps 12, the tongue 10 is automatically centred on the front portion 22 and on the aperture 8.

The assembly further comprises means for locking the tongue in the centred position. These means comprise grooves which form teeth 24 which are arranged on the straps 12 and a locking catch 26 which has a complementary shape and which is connected to the tongue 10. This locking catch 26 is resiliently deformable between an inactive position illustrated in FIG. 3, in which the catch is remote from the teeth 24, and an active position in which the catch engages in the teeth 24 in order to prevent the tongue 10 from sliding relative to the straps 12.

In the absence of any external action, the locking catch 26 is positioned in the inactive position and forms a protrusion on the tongue in the direction of the front portion 22.

When the straps 12 are tightened, the tongue 10 is pressed against a surface of the front portion 22 which then comes into contact with the locking catch 26, thus bringing it into an active position.

As illustrated in FIG. 2, the tongue 10 comprises two plastics components 10*a*, 10*b* which are assembled together, in this instance, by means of clipping. They are connected by means of ribs 28 and together define spaces, including two passages 20 intended for receiving the straps 12 which carry the tongue.

The locking catch 26 is produced by moulding with the tongue and more precisely in this instance with the plastics component 10*a*.

Of course, the invention is in no way limited to the embodiment which has been described above by way of non-limiting example. It would thus be possible to replace the rigid body 2 with a flexible sleeve, for example, to protect the forearm.

The invention claimed is:

1. A protective boot assembly for protecting a foot and leg comprising:

a substantially tubular body (2) extending in a longitudinal direction (6) to be adjusted around said limb, a front portion of the tubular body having an aperture (8) extending in the longitudinal direction, the aperture having a first edge on a first side of the aperture and a second edge on a second side of the aperture opposite the first side to form a spacing between the first and second edges;

a rigid tongue (10) extending from the first side to the second of said aperture to cover the front portion (22) of the tubular body; and a strap (12) extending transversely to the longitudinal direction and between the first and second edges of the aperture, said strap being connectable to the tubular body at the first side and the second side of the aperture in an adjustable manner in order to adjust the spacing between the edges of the aperture, wherein said tongue is mounted on an outside surface of the strap such that the tongue slides freely and such that the strap is sandwiched between the tongue and the tubular body, and wherein the tongue has a shape complementary to a shape of the front portion of the tubular body such that the tongue and the tubular body cooperate together to automatically centre the tongue relative to the aperture.

2. The assembly according to claim 1, further comprising:

locking means (24, 26) provided between the strap and the tubular body, wherein the locking means are configured to occupy an inactive position in which the locking means allow the tongue to slide freely on the strap, and an active position in which the locking means act counter to said sliding, and wherein the locking means are placed in the active position when the tongue is pressed against said front portion.

3. The assembly according to claim 2, wherein the locking means comprise grooves (24) provided in the strap, and a catch (26) having a shape configured to complement a shape of the grooves in order to engage therein, said catch resiliently assuming the inactive position in the absence of any external force and forming a protrusion relative to said tongue in a direction of said front portion when the catch is in the inactive position.

4. The assembly according to claim 3, wherein the catch is produced by moulding with the tongue.

5. The assembly according to claim 1, wherein the front portion has a non-circular cross-section, and wherein said tongue has a cross-sectional shape complementary to a cross-sectional shape of the front portion.

6. The assembly according to claim 5, wherein said front portion has a substantially parabolic cross-section.

7. The assembly according to claim 1, wherein the tongue comprises first and second plastic components (10*a*, 10*b*) assembled together, the second plastic component (10*b*) provided on the outside surface of the strap (12), and the first plastic component (10*a*) connected to the second plastic component (10*b*).

8. The assembly according to claim 1, wherein the tubular body is formed by a rigid boot shell.

9. The assembly according to claim 1, further comprising:

at least a second strap (12).

10. The assembly according to claim 2, wherein the front portion has a non-circular cross-section, and wherein said tongue has a cross-sectional shape complementary to a cross-sectional shape of the front portion.

11. The assembly according to claim 3, wherein the front portion has a non-circular cross-section, and wherein said tongue has a cross-sectional shape complementary to a cross-sectional shape of the front portion.

12. The assembly according to claim 4, wherein the front portion has a non-circular cross-section, and wherein said tongue has a cross-sectional shape complementary to a cross-sectional shape of the front portion.

13. The assembly according to claim 2, wherein the tongue comprises first and second plastic components (10*a*, 10*b*) assembled together, the second plastic component (10*b*) provided on the outside surface of the strap (12), and the first plastic component (10*a*) connected to the second plastic component (10*b*).

14. The assembly according to claim 3, wherein the tongue comprises first and second plastic components (10*a*, 10*b*) assembled together, the second plastic component (10*b*) provided on the outside surface of the strap (12), and the first plastic component (10*a*) connected to the second plastic component (10*b*).

15. The assembly according to claim 4, wherein the tongue comprises first and second plastic components (10*a*, 10*b*) assembled together, the second plastic component (10*b*) provided on the outside surface of the strap (12), and the first plastic component (10*a*) connected to the second plastic component (10*b*).

16. The assembly according to claim 5, wherein the tongue comprises first and second plastic components (10*a*, 10*b*) assembled together, the second plastic component (10*b*) provided on the outside surface of the strap (12), and the first plastic component (10*a*) connected to the second plastic component (10*b*).

17. The assembly according to claim 6, wherein the tongue comprises first and second plastic components (10*a*, 10*b*) assembled together, the second plastic component (10*b*) provided on the outside surface of the strap (12), and the first plastic component (10*a*) connected to the second plastic component (10*b*).

18. The assembly according to claim 2, wherein the tubular body is formed by a rigid boot shell.

19. The assembly according to claim 3, wherein the tubular body is formed by a rigid boot shell.

20. The assembly according to claim 4, wherein the tubular body is formed by a rigid boot shell.

* * * * *